US007380325B2

(12) United States Patent
Takeda

(10) Patent No.: US 7,380,325 B2
(45) **Date of Patent: *Jun. 3, 2008**

(54) METHOD FOR MANUFACTURING A GOLF CLUB HEAD

(75) Inventor: Hitoshi Takeda, Tsubame (JP)

(73) Assignee: K.K. Endo Seisakusho (JP)

( * ) Notice: Subject to any disclaimer, the term of this patent is extended or adjusted under 35 U.S.C. 154(b) by 407 days.

This patent is subject to a terminal disclaimer.

(21) Appl. No.: 10/836,952

(22) Filed: Apr. 30, 2004

(65) Prior Publication Data

US 2004/0231132 A1 Nov. 25, 2004

(30) Foreign Application Priority Data

Apr. 30, 2003 (JP) ..... 2003-125962

(51) Int. Cl.
*A63B 53/00* (2006.01)

(52) U.S. Cl. ..... 29/505; 473/349; 473/324

(58) Field of Classification Search ..... 473/292, 473/324, 349

See application file for complete search history.

(56) References Cited

U.S. PATENT DOCUMENTS 4,852,880 A * 8/1989 Kobayashi ..... 473/349
5,749,794 A * 5/1998 Kobayashi et al. ..... 473/342
6,200,228 B1 * 3/2001 Takeda ..... 473/324
7,040,000 B2 * 5/2006 Takeda ..... 29/505
2003/0119599 A1 * 6/2003 Byrne et al. ..... 473/340

FOREIGN PATENT DOCUMENTS

| | | |
|---|---|---|
| JP | 56-117846 | 9/1981 |
| JP | 63-109202 | 5/1988 |
| JP | 63-290590 | 11/1988 |
| JP | 02-256187 | 10/1990 |
| JP | 2000-084126 | 3/2000 |
| JP | 3059397 | 4/2000 |
| JP | 3140991 | 12/2000 |

* cited by examiner

*Primary Examiner*—David P. Bryant
*Assistant Examiner*—Christopher M Koehler
(74) *Attorney, Agent, or Firm*—Akerman Senterfitt

(57) ABSTRACT

An iron type head body comprises: a material body 13 made from a forgeable metal; and a disparate metallic member 12 made from a metal having nearly equal or smaller specific gravity than the material body 13, and different constituents. By providing the disparate metallic member 12 inside the upper portion of the head body not adjacent to the sole, the head can be lightened. Moreover, by confining the disparate metallic member 12 in the portion upside of the sole 4 not adjacent to the sole 5, the head body 11 can be hypobaric, while the C.G. of the head 2 can be lowered entirely in addition to being lightened.

4 Claims, 18 Drawing Sheets

METHOD FOR MANUFACTURING A GOLF CLUB HEAD

BACKGROUND OF THE INVENTION

1. Field of the Invention

The present invention relates to a method for manufacturing a golf club head.

2. Description of the Related Art

As a conventional technique, Japanese Patent Registered Publication No. 3059397 discloses a method for manufacturing a golf club head comprising the steps of forming a golf club head body from a forgeable metallic material of small specific gravity; providing a composite material member to a placing position locating inside the head body, the composite material member having large specific gravity compared to the head body and high melting point compared to the forging temperature of the forgeable material of the head body; and forming the head body by forging so as to confine the composite material member in the head body.

Moreover, Japanese Patent Registered Publication No. 3140991 discloses a method for manufacturing a golf club head joining a disparate metal member to a head body. This method comprises the steps of forming at least one opening or one concave portion on a head body member prior to shaping the head body; placing the disparate metal members in the opening(s) or concave portion; then joining the head body member and the disparate metal members together while forming the head body in a desired shape.

In the former method of the above-mentioned two conventional methods, a technique such as combining the head body with relatively small specific gravity and the composite material member of relatively large specific gravity is only available for lowering the C.G. of the head or enlarging the depth of the head (a distance between the center of the gravity of the head and a face) by placing the composite material member adjacent to the sole of the head, and thus the degree of freedom of designing the head would be limited. Moreover, as described above, the composite material member having larger specific gravity than that of the head body and higher melting point than the forging temperature of the head body is provided on the placing position inside the head body according to the first introduced method. This results in the fact such that the head body would crack up when the temperature of the inside of the head body does not reach the forging temperature, while it would be overheated when the temperature of the inside of the head body reaches the forging temperature. In order to prevent the head body from cracking, the composite material member needs to be placed on a portion of the head body where amount of the deformation due to forging is less. Accordingly, the degree of freedom of designing the head is further limited.

On the other hand, according to the latter conventional method, the opening(s) or concave portion is formed on the head body member prior to shaping the head body. Accordingly, the whole metallic material for forming the head body member is not utilizable, and thus there is a limitation in the reduction of the manufacturing cost.

Moreover, in a case manufacturing a wood type metal head by integrating a plurality of metallic shells while using the latter conventional method, a thickness of each metallic shell is generally arranged about 3.0 mm from a standpoint of effectiveness or the like. In this thickness, however, the head body including the disparate metal members would crack up when the temperature of the inside of the head body does not reach the forging temperature, while it would be overheated when the temperature of the inside of the head body reaches the forging temperature. By suitably designing the placing position of the disparate metal member, the head can be prevented from cracking, but the degree of freedom of designing the head is resultantly limited.

SUMMARY OF THE INVENTION

The present invention has been made to solve the above problems. It is accordingly an object of the present invention to provide a method for manufacturing a golf club head which can improve the degree of freedom of designing a head.

In order to attain the above object, according to a first aspect of the present invention, there is provided a method for manufacturing a golf club head, comprising the step of subjecting a metallic material to a hot forging so as to form at least a part of a golf club head prototype; and then subjecting a thus formed prototype to a finishing process, wherein at least a part of the metallic material is composed of a material body made from a forgeable material; and at least one disparate metallic member provided inside the material body, the disparate metallic member having nearly equal or smaller specific gravity and different composition than the material body.

In order to attain the above object, according to a second aspect of the present invention, there is provided a method for manufacturing a golf club head, comprising the steps of subjecting a metallic material to a hot forging so as to form a golf club head prototype having at least a face; and then subjecting the face to a finishing process, wherein the metallic material is composed of a material body made from a forgeable material, the material body having a bore; and at least one disparate metallic member provided inside the bore, the disparate metallic member having nearly equal or smaller specific gravity and different composition than the material body.

In the above-explained method, the disparate metallic member may be composed of a material whose melting point is not higher than a forging temperature of the material of the material body.

The material body may be an axial member, while the disparate metallic member may be inserted thereinto.

Alternatively, in the above-explained method, different types of the disparate metallic members may be disposed along a center of the axial member.

Different types of the disparate metallic members may be disposed concentrically around a center of the axial member.

The disparate metallic member provided inside the bore may have the same main constituent as the material body.

In the above-explained method, at least a part of the metallic material may be a face or a body of a hollow metal club head, or a face of an iron club head.

The material body may be an axial member, with the disparate metallic member being attached to a surface thereof.

Different types of the disparate metallic members may be disposed on the surface of the axial member.

The different types of the disparate metallic members may be stacked in layers.

The disparate metallic member attached to the surface of the axial member may have the same main constituent as that of the material body.

Further, in the above-explained method, at least a part of the metallic material may be a face or a body of a hollow metal club head, or a face of an iron club head.

In order to attain the above object, according to a third aspect of the present invention, there is provided a method for manufacturing a golf club head comprising: allowing a metallic material to contain n number of metallic members, the metallic material being for forming a golf club head having a face and a sole, and formed in a columnar shape, while n number of the metallic members having low melting point compared to a forging temperature of the metallic material respectively; shaping the golf club head by forging the metallic material and n number of the metallic members while heating the metallic material and n number of the metallic members at the forging temperature of the metallic material; and applying finishing processes to the shaped golf club head, wherein: n is a natural number; and the golf club head is shaped by forging the metallic material and n number of the metallic members so that n number of the metallic members are confined inside the golf club corresponding to either the face or the sole of the golf club head.

In the above-explained method for manufacturing a golf club head, the metallic material may be allowed to contain n number of the metallic members by: equiaxially forming the metallic material with a bore; inserting n number of the metallic members into the bore; and plugging the bore while using a plug made from a metal having the same major constituent as the metallic material.

Moreover, in the above-explained method for manufacturing a golf club head, n may be 1; and the golf club head may be shaped by: inserting the one metallic member into the bore and plugging the bore; and forging the metallic material and the one metallic member so that the one metallic member is confined inside the golf club head corresponding to an upper part of the face of the golf club head.

Alternatively, n may be 1; and the golf club head may be shaped by: inserting the one metallic member into the bore and plugging the bore; and forging the metallic material and the one metallic member so that the one metallic member is confined inside the golf club head corresponding to the sole of the golf club head.

Moreover, n may be 2; and the golf club head may be shaped by: inserting the two metallic members stacked in layers into the bore and plugging the bore, the two metallic members made from different materials respectively, one of the metallic members having large specific gravity compared to the metallic material, while an other of the metallic members having small specific gravity compared to the metallic material; and forging the metallic material and the two metallic members so that the two metallic members are confined inside the golf club head in a stacked condition, corresponding to a center of the face of the golf club head in a stacked condition.

Further, n may be 2; and the golf club head may be shaped by: inserting the two metallic members into the bore and plugging the bore, the two metallic members made from different materials respectively and formed in a concentric circle as a whole, one of the metallic members having large specific gravity compared to the metallic material and defining an outward of the concentric circle, while the other of the metallic members having small specific gravity compared to the metallic material and defining an inward of the concentric circle; and forging the metallic material and the two metallic members so that the two metallic members are confined inside the golf club head corresponding to a center of the face of the golf club head in a stacked condition.

Still further, n may be 3; and the golf club head may be shaped by: inserting the three metallic members into the bore so as to allow a first metallic member to be pinched by second and third metallic members from right and left of the first metallic member and plugging the bore, the first metallic member having small specific gravity compared to the metallic material, while the second and third metallic members having large specific gravity compared to the metallic material; and forging the metallic material and the three metallic members so that the three metallic members are confined inside the golf club head corresponding to a center of the face of the golf club head in a stacked condition.

In the above-explained method for manufacturing a golf club head, n may be 1; and the golf club head may be shaped by: inserting the one metallic member into the bore and plugging the bore, the one metallic member containing large amount of carbon compared to the metallic material; forging the metallic material and the one metallic member so that the one metallic member is confined inside the golf club head corresponding to an upper part of the face of the golf club head; and forming a concave portion so as to manufacture a cavity type the golf club head.

In the above explained method for manufacturing a golf club head, the metallic material may be allowed to contain n number of the metallic members by: attaching n number of the metallic members on a surface region of the metallic material.

In order to attain the above object, according to a second aspect of the present invention, there is provided a method for manufacturing a golf club head comprising: allowing a metallic material to contain n number of metallic members, the metallic material being for forming a predetermined portion among a plural portions of the golf club head and formed in a columnar shape, while n number of the metallic members each having low melting point compared to a forging temperature of the metallic material, n being a natural number excluding zero; shaping the predetermined portion of the golf club head by forging the metallic material and n number of the metallic members while heating the metallic material and n number of the metallic members at the forging temperature of the metallic material, the shaped predetermined portion of the golf club head confining n number of the metallic members therein; joining the plural portions one another so as to form the golf club head, the plural portions including the shaped predetermined portion; and applying finishing processes to the shaped predetermined portion of the golf club head.

In the above-explained method for manufacturing a golf club head, the golf club head may be a hollow metal club head comprising a plurality of metallic shells; and the predetermined portion may be a face of the golf club head.

Moreover, n may be 1; and the metallic material and the one metallic member have the same main constituent.

Further, in the above-explained method for manufacturing a golf club head, the other portions may comprise an iron type body as a whole; and the predetermined portion may be a face of said golf club head.

Moreover, n may be 1; and the metallic material and the one metallic member may have the same main constituent with each other.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

A preferred embodiment of the present invention will now be described in detail with reference to the accompanying drawings.

First Embodiment

Figure 1:
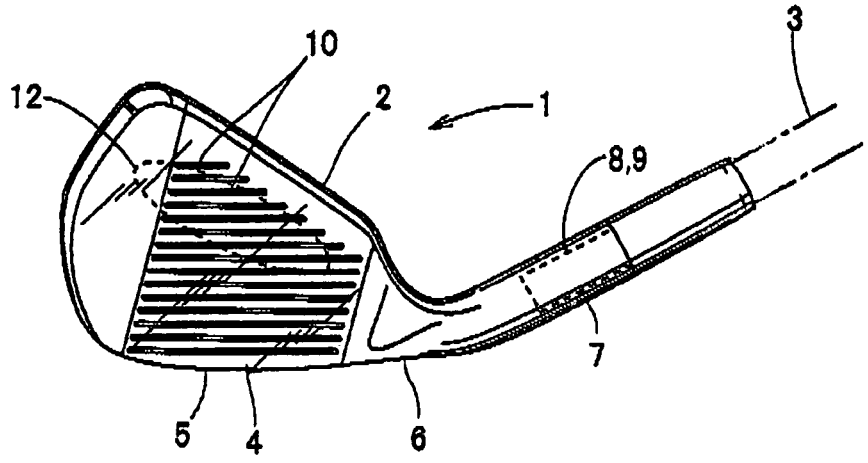
FIG. 1 is a perspective view showing a structure of a golf club head according to a first embodiment of the present invention.
Figure 2:
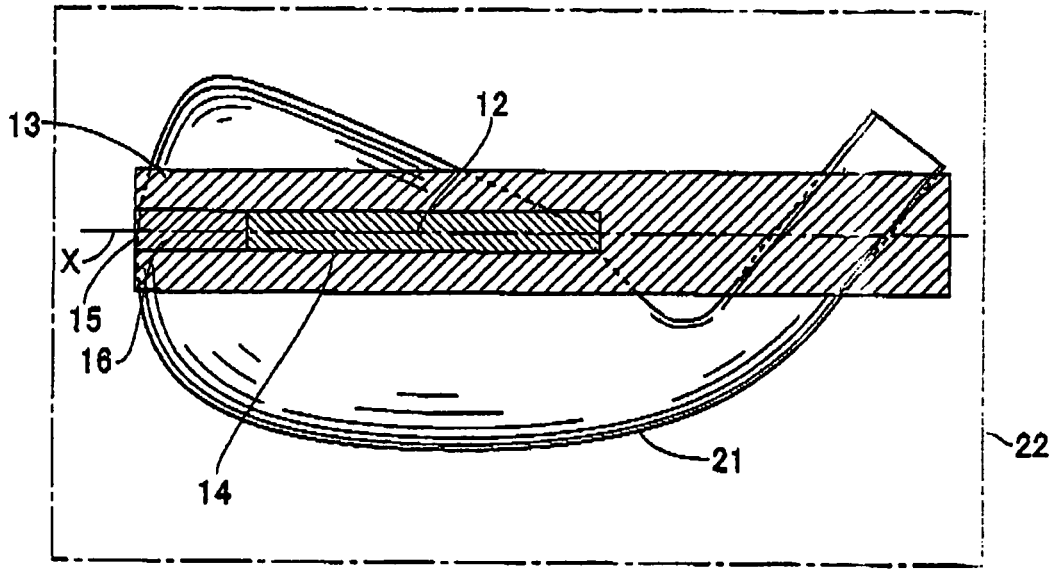
FIG. 2 is a transverse sectional view for explaining a method for manufacturing the golf club head according to the first embodiment of the present invention.
Figure 3:
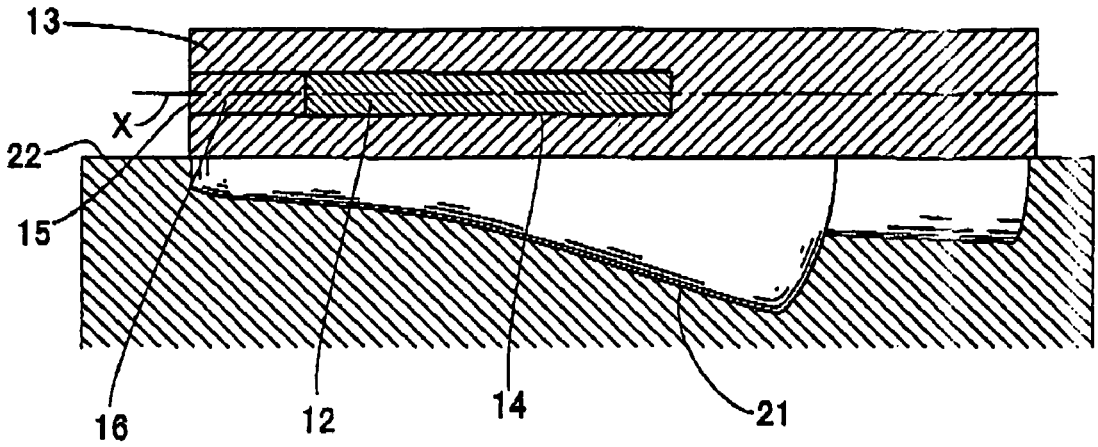
FIG. 3 is a longitudinal sectional view for explaining the method for manufacturing the golf club head according to the first embodiment.
Figure 4:
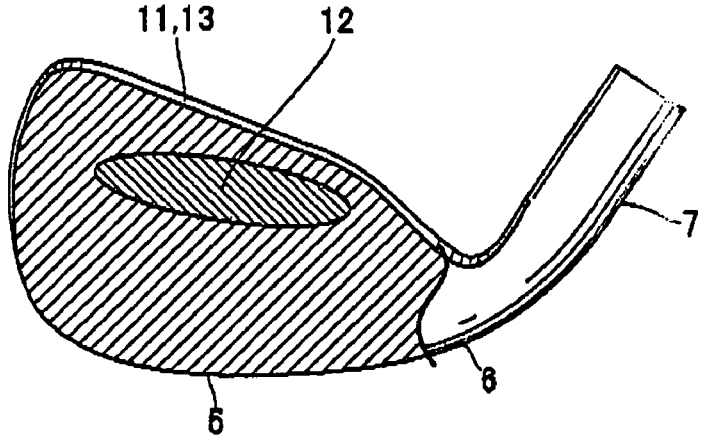
FIG. 4 is a schematic front view showing the golf club head according to the first embodiment.
Figure 5:
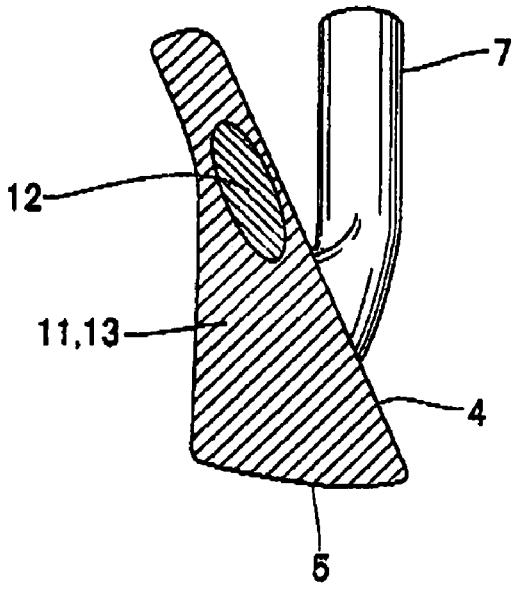
FIG. 5 is a cross sectional view showing the golf club head according to the first embodiment.
Figure 6:
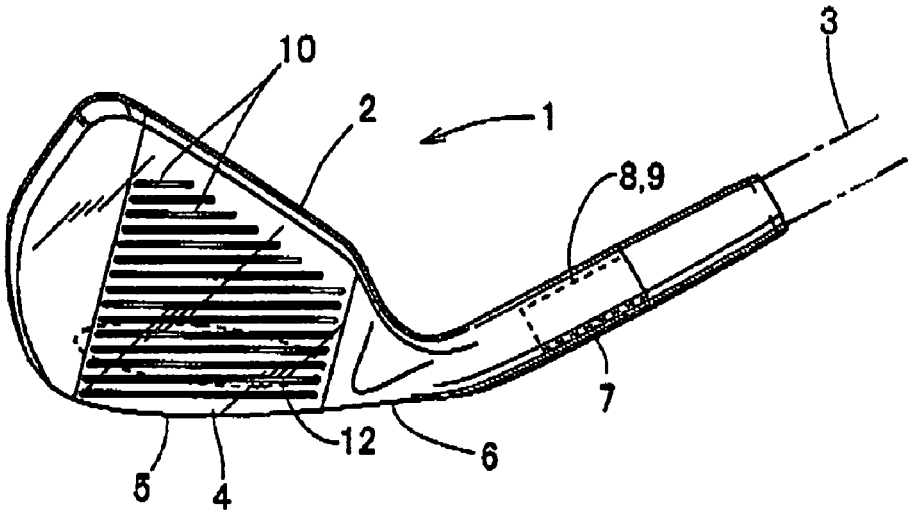
FIG. 6 is a perspective view showing a structure of a golf club head according to a second embodiment of the present invention.
Figure 7:
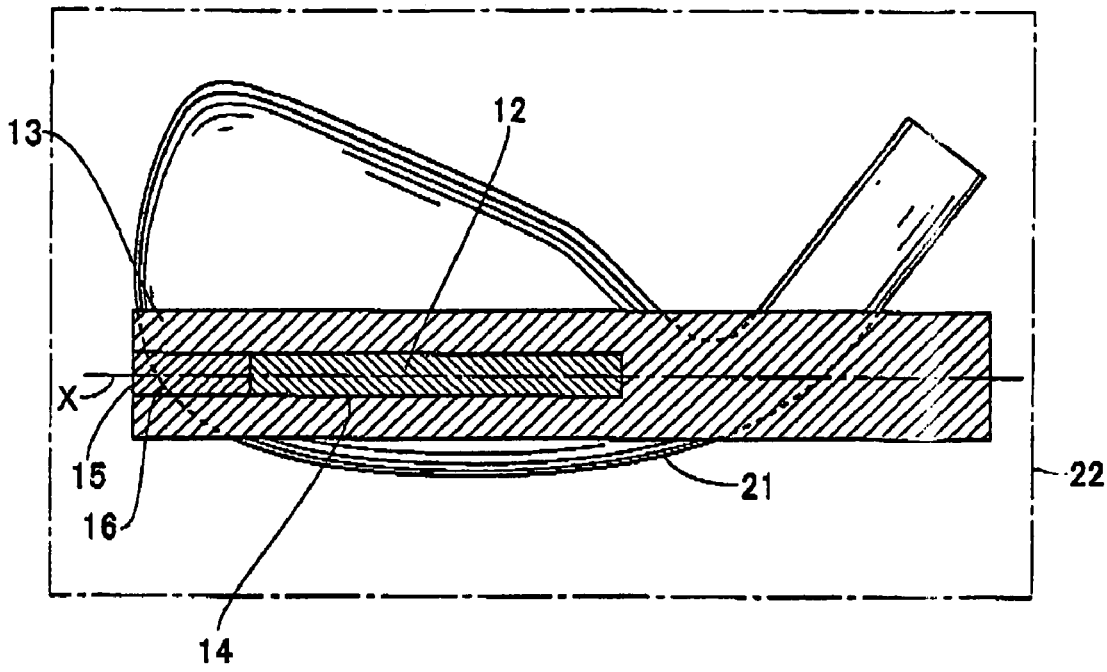
FIG. 7 is a transverse sectional view for explaining a method for manufacturing a golf club head according to the second embodiment of the present invention.
Figure 8:
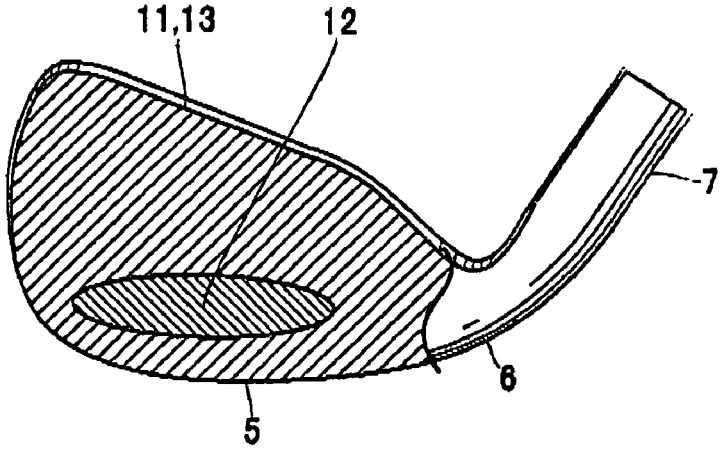
FIG. 8 is a schematic front view showing the golf club head according to the second embodiment.
Figure 9:
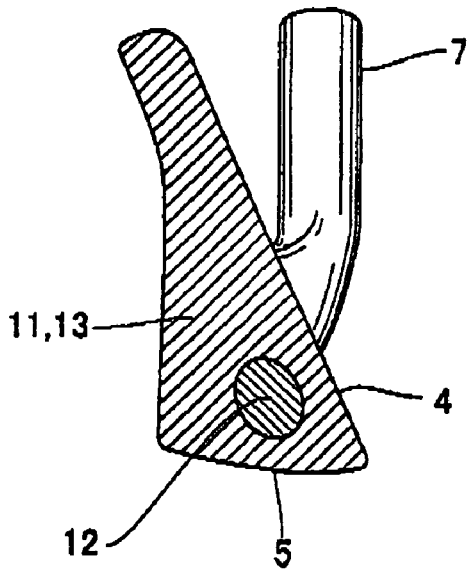
FIG. 9 is a cross sectional view showing the golf club head according to the second embodiment.
Figure 10:
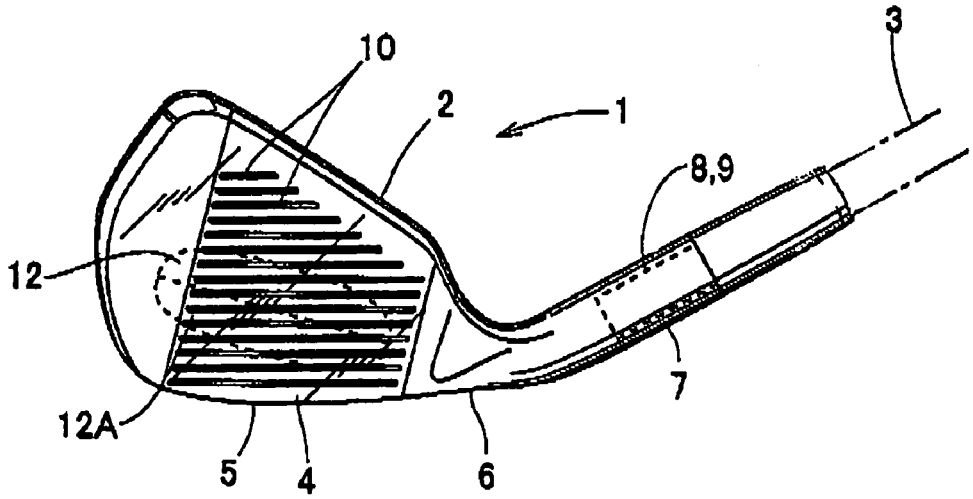
FIG. 10 is a perspective view showing a structure of a golf club head according to a third embodiment of the present invention.
Figure 11:
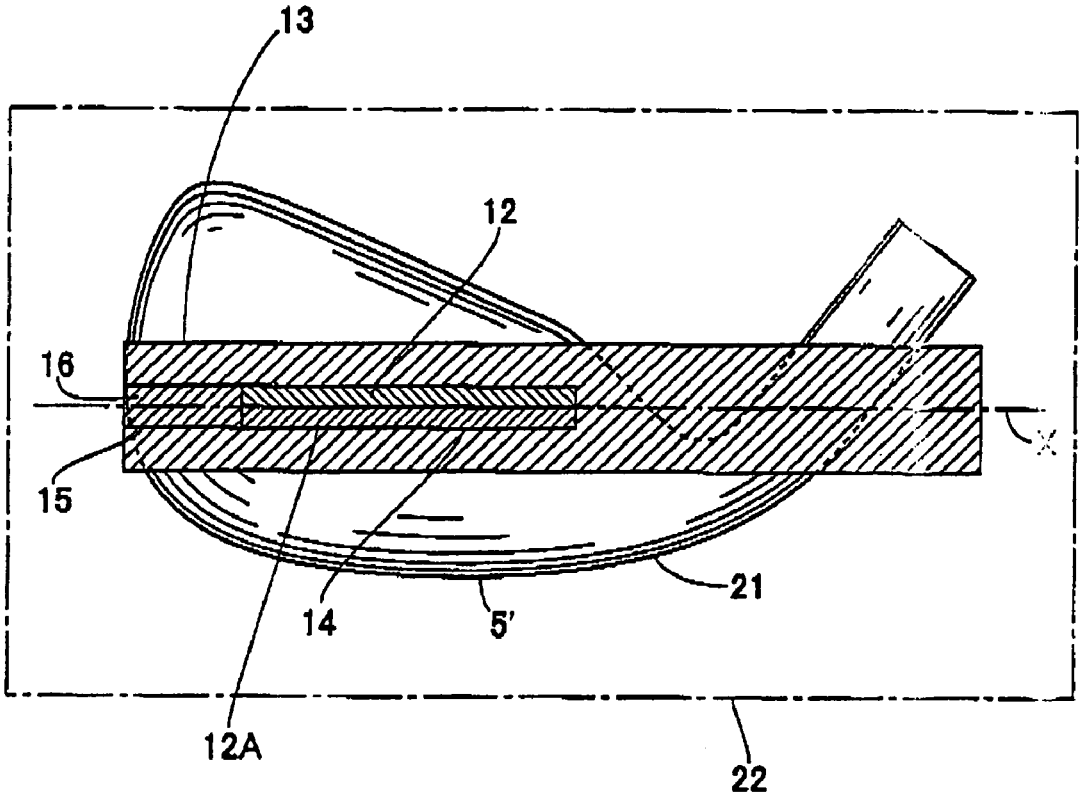
FIG. 11 is a transverse sectional view for explaining a method for manufacturing the golf club head according to the third embodiment.
Figure 12:
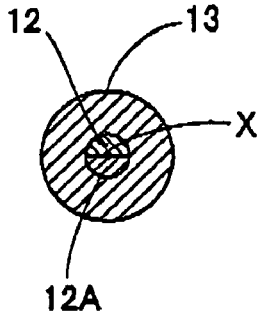
FIG. 12 is a longitudinal sectional view showing materials of disparate metallic members included in the golf club head according to the third embodiment.
Figure 13:
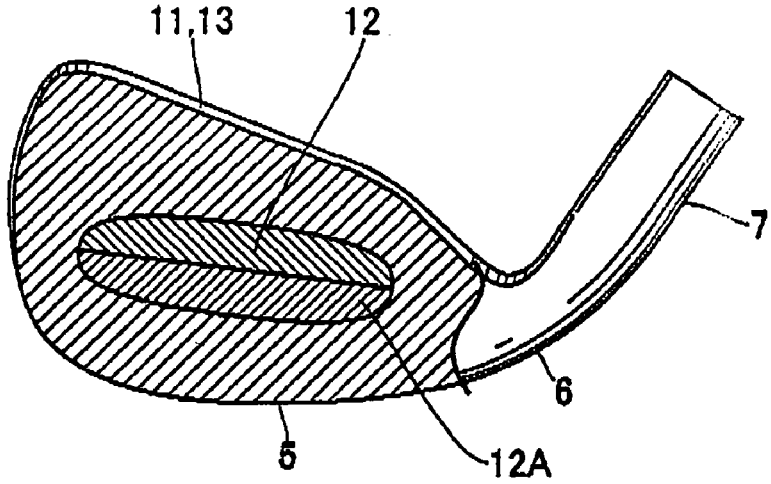
FIG. 13 is a schematic front view showing the golf club head according to the third embodiment.
Figure 14:
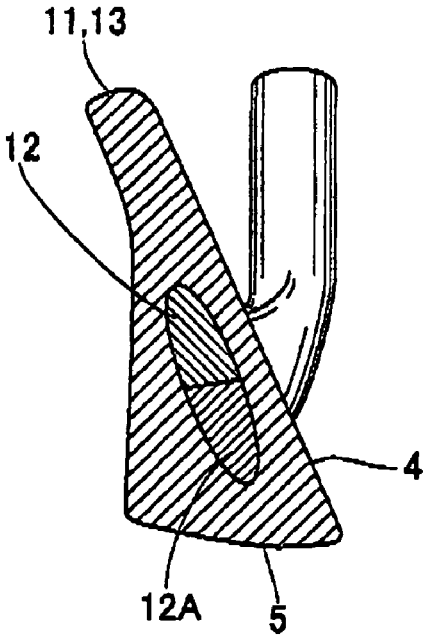
FIG. 14 is a cross sectional view showing the golf club head according to the third embodiment.
Figure 15:
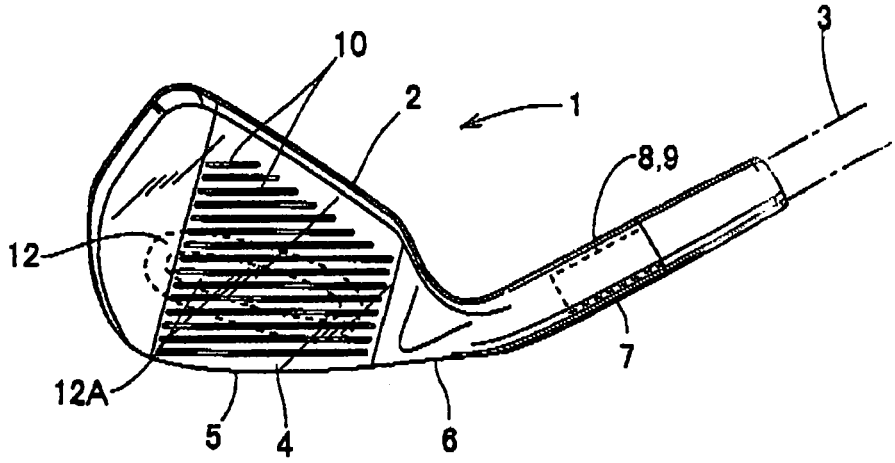
FIG. 15 is a perspective view showing a structure of a golf club head according to a fourth embodiment of the present invention.
Figure 16:
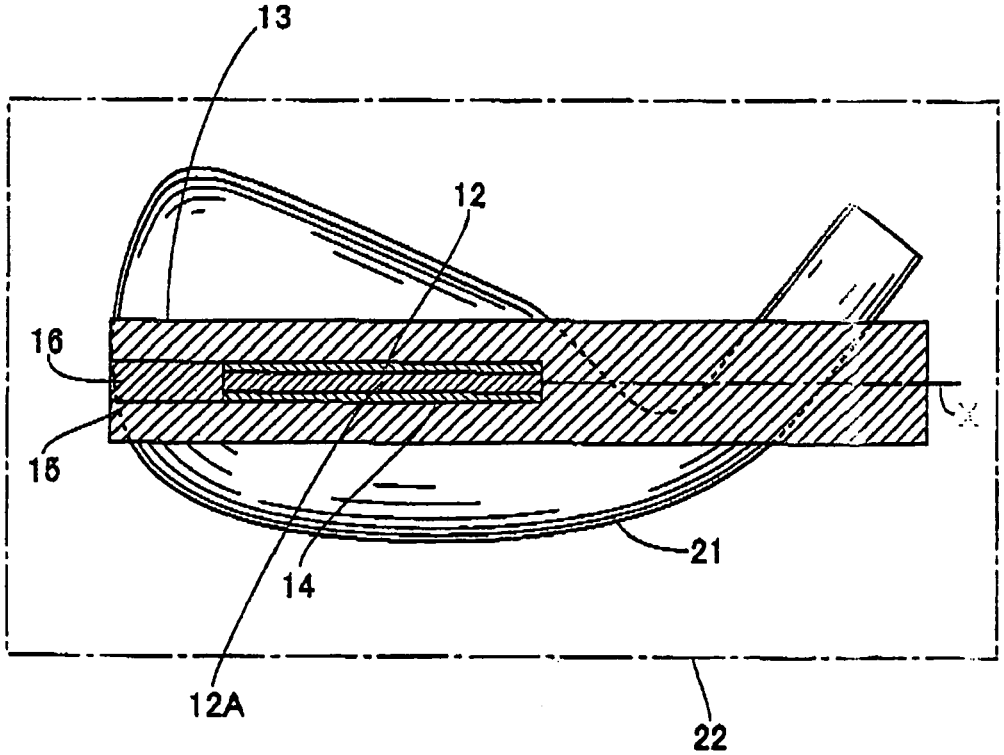
FIG. 16 is a transverse sectional view for explaining a method for manufacturing a golf club head according to the fourth embodiment.
Figure 17:
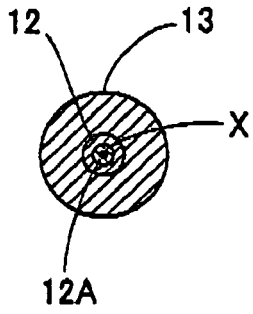
FIG. 17 is a longitudinal sectional view showing materials of disparate metallic members included in the golf club head according to the fourth embodiment.
Figure 18:
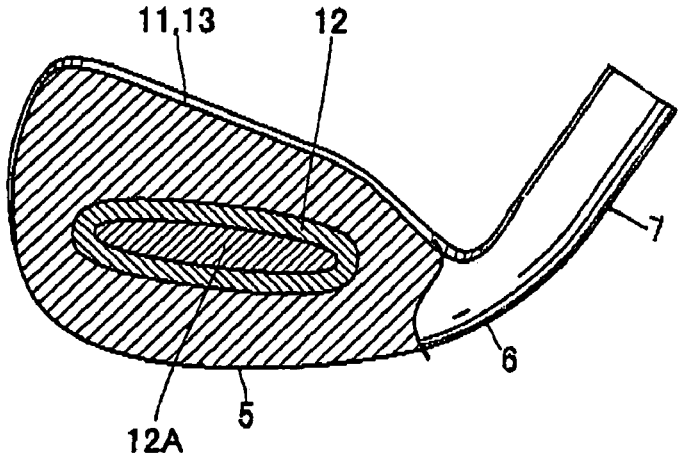
FIG. 18 is a schematic front view showing the golf club head according to the fourth embodiment.
Figure 19:
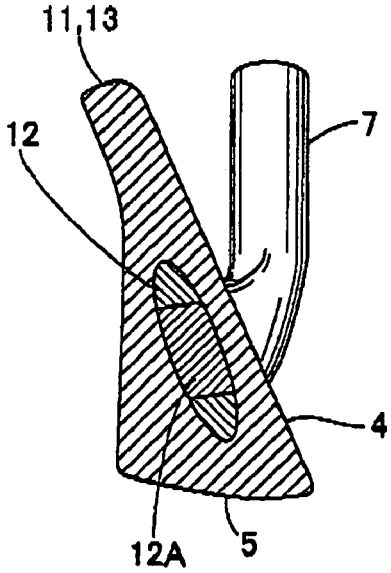
FIG. 19 is a cross sectional view showing the golf club head according to the fourth embodiment.
Figure 20:
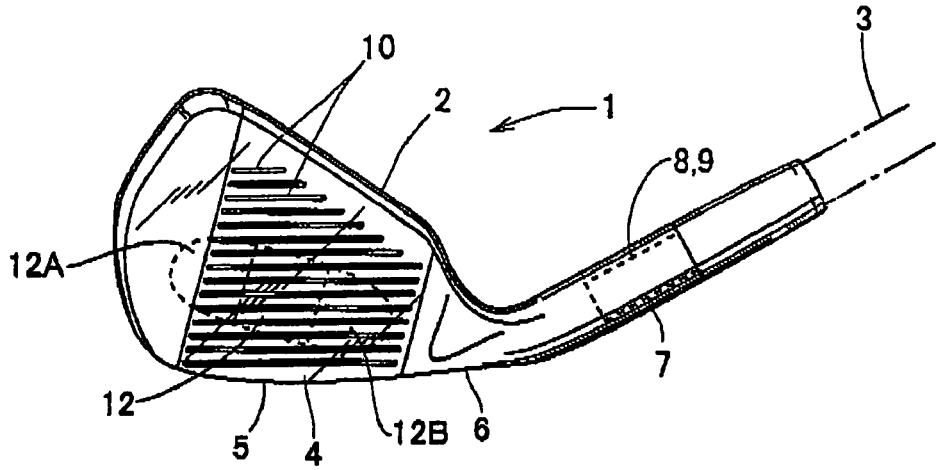
FIG. 20 is a perspective view showing a structure of a golf club head according to a fifth embodiment of the present invention.
Figure 21:
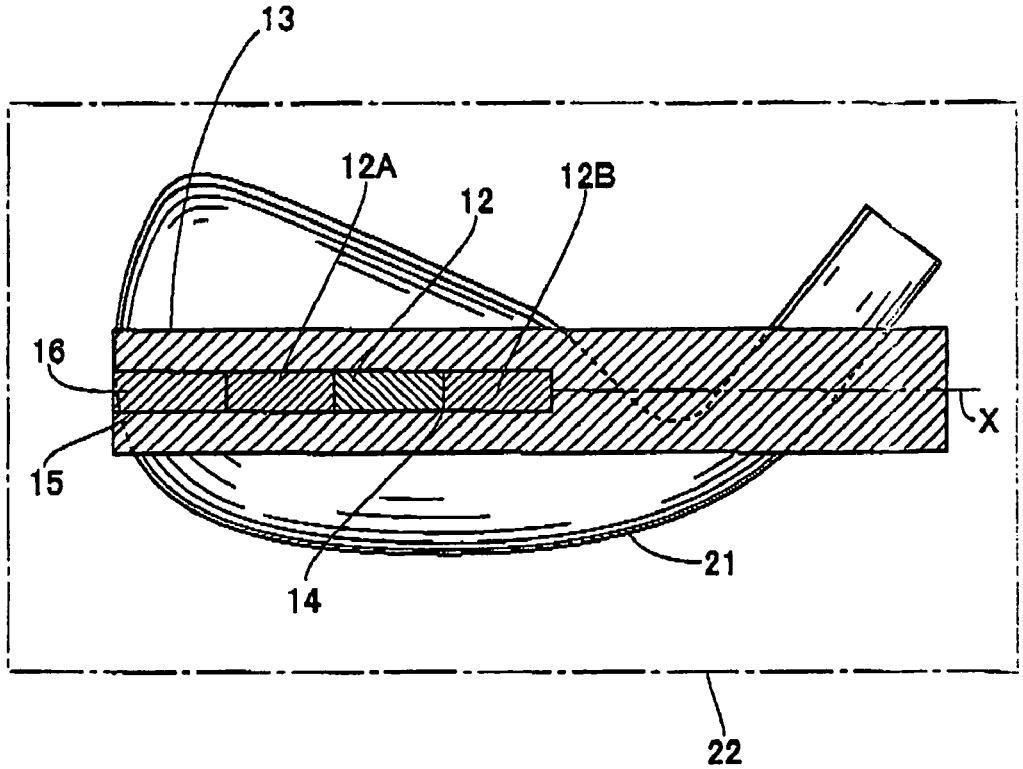
FIG. 21 is a transverse sectional view for explaining a method for manufacturing the golf club head according to the fifth embodiment.
Figure 22:
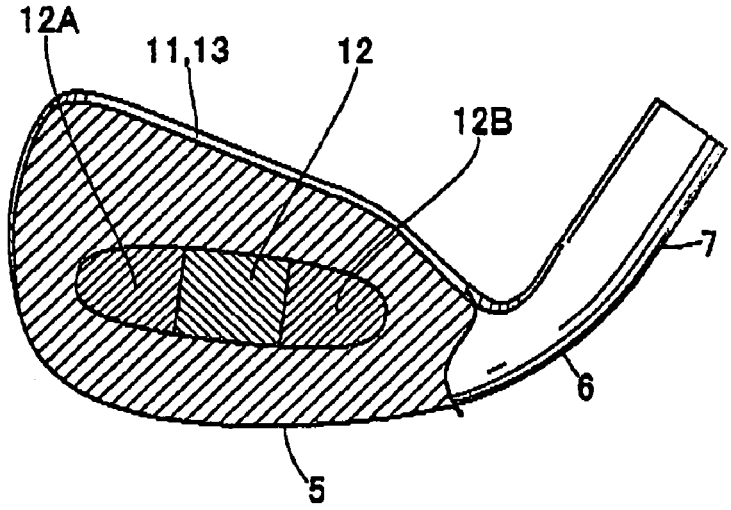
FIG. 22 is a schematic front view showing the golf club head according to the fifth embodiment.
Figure 23:
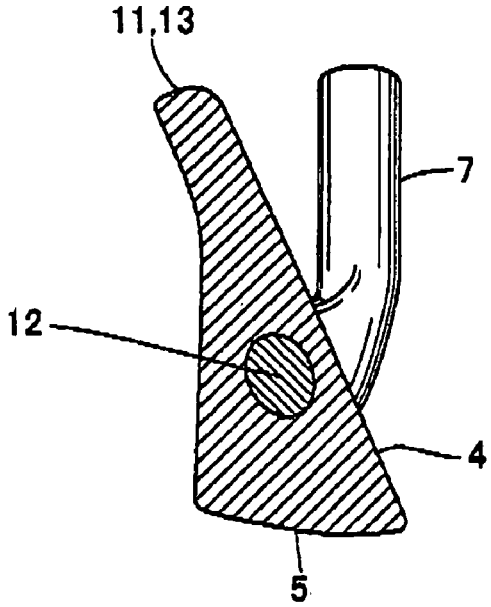
FIG. 23 is a cross sectional view showing the golf club head according to the fifth embodiment.

A first embodiment will now be described with reference to FIGS. 1 to 5. As shown in FIG. 1, an iron type golf club head 1 comprises: a head 2; and a shaft 3 connected to the head 2. The head 2 has a face 4 serving as a striking surface on its front surface, while it has a sole 5 on its bottom surface as a ground plane. Further, the head 2 has a heel 6 on one side surface thereof, while it has a hosel 7 above the heel 6 as a connecting member of the shaft 3 so that the hosel 7 is arranged to extend obliquely upward with an angle. The hosel 7 has a bore 8, while one end 9 of the shaft 3 is connected to the bore 8. Meanwhile, a plurality of grooves 10 as so-called score lines are formed on the face 4 laterally.

The head 2 comprises a head body 11 which is made from a forgeable (malleable) metal with strength to withstand hits by a golf ball. The forgeable metal comprises, for example, steel (S20C). The face 4, sole 5 and hosel 7 are formed on the head body 11, while a disparate metallic member 12 made from one kind of metals is provided horizontally on the inside of the head body 11 corresponding to the upper portion of the face 4. To be more precise, the disparate metallic member 12 is placed spindly in the longitudinal direction of the head body 11 from the right and left thereof The disparate metal 12 is made from a material such as aluminum, aluminum alloy or the like having small specific gravity compared to the material of the head body 11 and low melting point compared to the forging temperature of the material of the material body 13.

Next, a method for manufacturing the head 2 will now be described. The metallic materials for forming the head body 11 are: a material body 13 comprising the above-described forgeable metal (for example, S20C steel) in a columnar shape; and a disparate metallic member 12 provided inside a bore 14 formed on the material body 13 along the axial direction X of the material body 13. After the disparate metallic member 12 is provided inside the bore 14, the disparate metallic member 12 is confined therein by, for example, plugging the bore 14 with a plug 16 and welding it to the lip of the bore 14. The plug 16 is made from the same material as that of the material body 13 or a material having the same main constituent as the material of the material body 13.

Then, the material body 13 in which the disparate metallic member 12 is inserted inside the bore 14 is placed on a lower die 22 having a mold 21 for forming the material body 13 in a shape of the head body 11. Meanwhile, before the material body 13 is placed on the lower die 22, it is pre-heated at its hot forging temperature by a furnace or the like. Accordingly, the disparate metallic member 12 made from aluminum or aluminum alloy is in molten state. In a state where the material body 13 is pre-heated at a predetermined temperature and placed on the lower die 22, the head body 11 is formed by forging for allowing an upper die (not shown) to press the material body 13. Further, finishing processes such as forming the score lines (grooves 10) on the face 4 of the head body 11, polishing the entire surface of the head body 11, forming the bore 8 on the hosel 7 or the like are carried out.

As described above, according to the first embodiment of the present invention, the iron type head body 11 comprises: the material body 13 made from the forgeable metal; and the disparate metallic member 12 provided inside the material body 13 and having small specific gravity compared to the material body 13. Since the disparate metallic member 12 having small specific gravity is confined inside the upper portion of the head body 11, the head 2 can be lightened. Moreover, by confining the disparate metallic member 12 in the portion upside of the sole 4 which is not adjacent to the sole 5, the head body 11 can be hypobaric and the C.G. of the head can be lowered entirely in addition to being lightened.

Further, according to this embodiment, the disparate metallic member 12 is made from a material having low melting point compared to the forging temperature of the material body 13. This makes it possible to prevent the disparate metallic member 12 from cracking up when inside of the head body 11 does not reach the forging temperature, and to prevent the head body 11 from being overheated when inside thereof reaches the forging temperature. Accordingly, it is not necessary as the conventional technique to select a placing position for confining the disparate metallic member 12 where the amount of deformation when forged is less, and thus the degree of freedom of designing the head 2 is not limited.

Other embodiments of the present invention will now be described below. Meanwhile, the same reference numbers denote the same components as the first embodiment, while detailed explanation for those will be omitted.

Second Embodiment

As shown in FIGS. 6 to 9, the head 2 according to a second embodiment comprises the head body 11 which is made from a forgeable (malleable) metal with strength to withstand hits by a golf ball. The forgeable metal comprises, for example, steel (S20C). The face 4, sole 5 and hosel 7 are formed on the head body 11, while the disparate metallic member 12 made from one kind of metals is provided horizontally on the inside of the head body 11 corresponding to the bottom of the face 4. To be more precise, the disparate metallic member 12 is provided spindly in the longitudinal direction of the head body 11 from the right and left thereof The disparate metal 12 is made from a material such as pure titanium, titanium alloy or the like having small specific gravity compared to the head body 11 and low melting point compared to the forging temperature of the material of the material body 13.

The material body 13 in which the disparate metallic member 12 is inserted in the bore 14 is placed on the lower die 22 having a mold 21 for forming the material body 13 in a shape of the head 11. Meanwhile, the material body 13 is pre-heated at hot its forging temperature by a furnace or the like. Accordingly, the disparate metallic member 12 made from pure titanium, titanium alloy or the like is in molten state. In a state where the material body 13 is pre-heated at the predetermined temperature and placed on the lower die 22, the head body 11 is formed by forging for allowing an upper die (not shown) to press the material body 13. Further, finishing processes such as forming score lines (grooves 10) on the face 4 of the head body 11, polishing the entire surface of the head body 11, forming the bore 8 on the hosel 7 or the like are carried out.

As described above, according to the second embodiment of the present invention, the disparate metallic member 12 is confined inside the bottom portion of the head body 11, which is a portion adjacent to the sole 5. Accordingly, the thickness of the sole 5 in the face 4 can be increased, and thus a feeling when hitting a golf ball can be improved, while the strength of the head 2 can also be improved.

Meanwhile, the disparate metallic member 12 is made from pure titanium or titanium alloy, but it may be made from pure iron relative to the material body 13 made from steel (S20). In this case, the material body 13 and the disparate metallic member 12 have the same main constituent and essentially the same specific gravity, while the melting point of the disparate metallic member 12 is also essentially the same as the forging temperature of the material of the material member 13. Those facts make it possible to improve the feeling when hitting a golf ball. Further, the disparate metallic member 12 may be made from Cu—Al—Mn alloy relative to the material body 13 made from steel (S20C). In this case, the combined specific gravity of the material body 13 and the disparate metallic member 12 would be 7.3. This results in the improvement of the feeling when hitting a golf ball.

Third Embodiment

As shown in FIGS. 10 to 14, the head 2 according to a third embodiment comprises the head body 11 which is made from a forgeable (malleable) metal with strength to withstand hits by a golf ball The forgeable metal comprises, for example, steel (S20C). The face 4, sole 5 and hosel 7 are formed on the head body 11. First and second disparate metallic members 12, 12A made from two different kinds of metals are provided horizontally on the inside of the head body 11 corresponding to the center of the face 4, while the first and second disparate metallic members 12, 12A are stacked in layers. To be more precise, the first and second disparate metallic members 12, 12A are provided spindly in the longitudinal direction of the head body 11 from the right and left thereof. The first disparate metallic member 12 stacked above the second disparate metallic member 12A has small specific gravity compared to the material body 13 and low melting point compared to the forging temperature of the material of the material body 13, while it is made from, for example, aluminum, aluminum alloy. On the contrary, the second disparate metallic member 12A stacked on the below of the first disparate metallic member 12 has large specific gravity compared to that of the head body 11 and low melting point compared to the forging temperature of the material of the material body 13, while it is made from, for example, copper, copper alloy.

A method for manufacturing the head 2 according to the third embodiment will now be described. The metallic materials for forming the head body 11 are: the material body 13 comprising the above-described forgeable metal (for example, S20C steel) in a columnar shape; and the first and second disparate metallic members 12, 12A stacked in layers and both inserted into the bore 14 formed on the material body 13 along the axial direction X of the material body 13. In a state where the second disparate metallic member 12A locates adjacent to the sole forming side 5' in the mold 21, the metallic materials for forming the head body 11 are placed on the lower die 22 and a hot forging is carried out. Namely, the metallic materials are hot forged while allowing the first and second disparate metallic members 12, 12A to be stacked in layers and provided inside the material body 13.

As described above, according to the third embodiment of the present invention, the first and second disparate metallic members 12, 12A are confined in the inside of the head body 11 corresponding to a center of the face 4 so as to be stacked in layers. The thickness of the face 4 can be increased because of the confined first disparate metallic member 12, and thus a feeling when hitting a golf ball can be improved, while the strength of the head 2 can also be improved. On the contrary, the C.G. of the head 2 can be lowered because of the confined second disparate metallic member 12A.

Fourth Embodiment

As shown in FIGS. 15 to 19, the head 2 according to a fourth embodiment comprises the head body 11 made from a forgeable (malleable) metal with strength to withstand hits by a golf ball. The forgeable metal comprises, for example, steel (S20C). The face 4, sole 5 and hosel 7 are formed on the head body 11, while the first and second disparate metallic members 12, 12A made from two different kinds of metals are provided horizontally on the inside of the head body 11 corresponding to the center of the face 4. To be more precise, the first and second disparate metallic members 12, 12A are placed spindly in the longitudinal direction of the head body 11 along the axial direction X of the material body 13 so that the first disparate metallic member 12 is provided inwardly and the second disparate metallic member 12A is provided outwardly with respect to each other. As the combination of the materials of the first and second disparate metallic members 12, 12A, the first disparate metallic member 12 is made from, for example, spring steels (JIS indication: SUP), while the second disparate metallic member 12A is made from, for example, Ni—Be alloy. Moreover, the first disparate metallic member 12 may be made from copper or copper alloy, while the second disparate metallic member 12A may be made from aluminum or aluminum alloy. The first disparate metallic member 12 (copper or copper alloy made) provided outwardly has large specific gravity compared to the head body 11 and low melting point compared to the forging temperature of the material of the material body 13. On the contrary, the second disparate metallic member 12A (aluminum or aluminum alloy made) provided inwardly has small specific gravity compared to that of the head body 11 and low melting point compared to the forging temperature of the material of the material body 13.

A method for manufacturing the head 2 according to the fourth embodiment will now be described. The metallic materials for forming the head body 11 are: the material body 13 comprising the above-described forgeable metal in a columnar shape; and the first and second disparate metallic members 12, 12A equiaxially inserted into the bore 14 formed on the material body 13 along the axial direction X of the material body 13. In a state where the second disparate metallic member locates adjacent to the sole forming side in the mold 21, the metallic materials are placed on the lower die 22, and a hot forging is carried out. Namely, the metallic materials are hot forged while allowing the first and second disparate metallic members 12, 12A to be provided inside the material body 13.

As described above, according to the fourth embodiment of the present invention, the first and second disparate metallic members 12, 12A are confined inside the head body 11 corresponding to the center of the face 4 so that the first disparate metallic member 12 is provided outwardly, while the second disparate metallic member 12A is provided inwardly corresponding to each other. By employing this structure, a feeling when hitting a golf ball can be improved, and the C.G. of the head 2 can be lowered.

Fifth Embodiment

As shown in FIGS. 20 to 23, the head 2 according to a fifth embodiment comprises the head body 11 which is made from a forgeable (malleable) metal with strength to withstand hits by a golf ball. The forgeable metal comprises, for example, steel (S20C). The face 4, sole 5 and hosel 7 are formed on the head body 11, while first, second and third disparate metallic members 12, 12A, 12B made from different kinds of metals of the head body 11 are provided inside the head body 11. The first disparate metallic member 12 is provided inside the head body 11 corresponding to the center of the face 4, while the second and the third disparate metallic members 12A, 12B are respectively provided on the right and left of the first disparate metallic member 12. The first disparate metallic member 12 is made from, for example, aluminum or aluminum alloy. The first disparate metallic member 12 has small specific gravity compared to that of the head body 11 and low melting point compared to the forging temperature of the material of the material body 13. The second and third disparate metallic member 12A, 12B are made from, for example, copper or copper alloy. Each of the second and third disparate metallic member 12A, 12B has large specific gravity compared to that of the head body 11 and low melting point compared to the forging temperature of the material of the material body 13.

A method for manufacturing the head 2 according to the fifth embodiment will now be described. The metallic materials for forming the head body 11 are: the material body 13 comprising the above-described forgeable metal (steel) in a columnar shape; and the disparate metallic members 12, 12A, 12B equiaxially inserted into the bore 14 formed on the material body 13 along the axial direction X of the material body 13 so that the second and the third disparate metallic members 12A, 12B locate on the right and left of the first disparate metallic member 12. The metallic materials are placed on the lower die 22, and a hot forging is carried out. Namely, the metallic materials are hot forged while allowing the disparate metallic members 12, 12A, 12B to be provided on the inside of the material body 13.

By providing the first disparate metallic member 12 on the inside of the head body 11 corresponding to the center of the face 4, the thickness of the face 4 can be increased, and thus a feeling when hitting a golf ball can be improved. In addition, by providing the second and third disparate metallic members 12A, 12B on the right and left of the first disparate metallic member 12, the weight-balance of the head 2 can be adjustable, and thus the moment of the head 2 can be adjusted.

Sixth Embodiment

Figure 24:
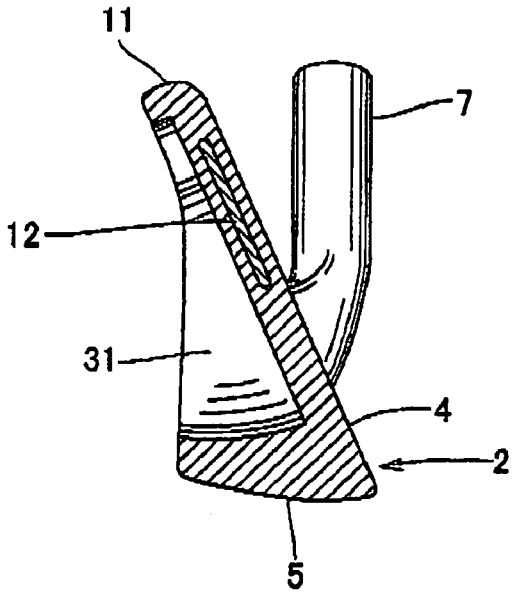
FIG. 24 is a cross sectional view showing a golf club head according to the sixth embodiment.
Figure 25:
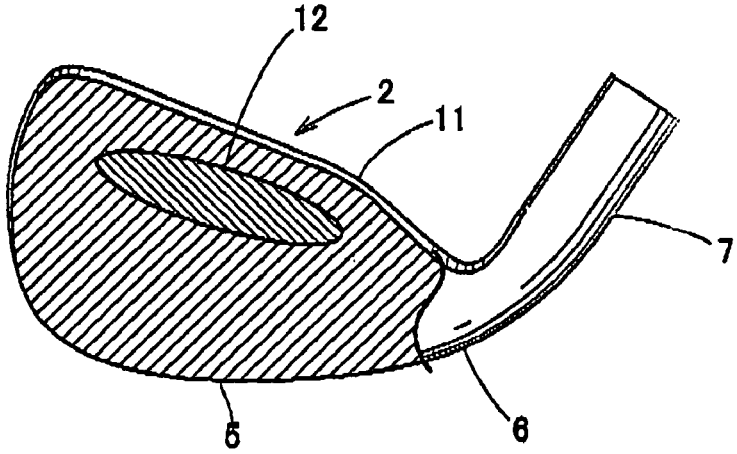
FIG. 25 is a schematic front view showing the golf club head according to the sixth embodiment.

As shown in FIGS. 24 and 25, the head 2 according to a sixth embodiment comprises the head body 11 which is made from a forgeable (malleable) metal with strength to withstand hits by a golf ball. The forgeable metal comprises, for example, steel (S10C). The face 4, sole 5 and hosel 7 are formed on the head body 11, while a concave portion 31 is formed on the rear of the head body 11 so that the head body 11 is to be cavity type. The disparate metallic member 12 made from one kind of metals different from that of the head body 11 is provided on the inside of the head body 11 corresponding to the upper of the face 4. The disparate metallic member 12 is made from, for example, S50C (JIS indication). The face 4 of the head body 11 made from S10C and the disparate metallic member 12 made from S50C have essentially the same specific weight, while the disparate metallic member 12 has large amount of carbon compared to the face 4 of the head body 11. By employing the above-described structure, the strength of the face 4 can be improved and reflection coefficient thereof can also be improved. Moreover, in a case where the head body 11 is made from pure titanium or titanium alloy and the disparate metallic member 12 is made from Ti-15V-3Cr-3Sn-3Al, the strength of the face 4 can be improved by the material of the disparate metallic member 12, Ti-15V-3Cr-3Sn-3Al. Further, in a case where the head body 11 is made from pure titanium or titanium alloy and the disparate metallic member 12 is made from aluminum or aluminum alloy, the specific gravity of the head 2 can be reduced, and thus the size of the head 2 can be enlarged.

Seventh Embodiment

Figure 26:
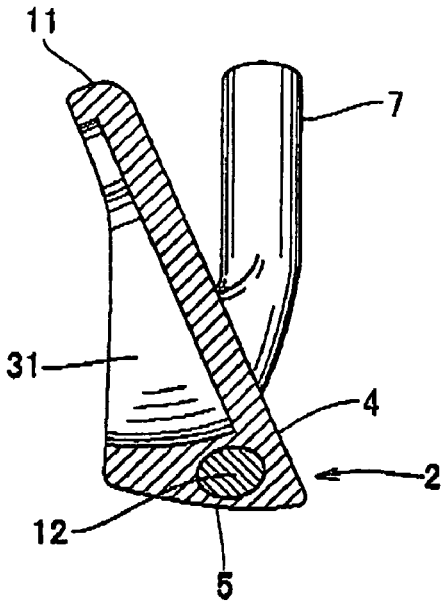
FIG. 26 is a cross sectional view showing the golf club head according to the seventh embodiment.
Figure 27:
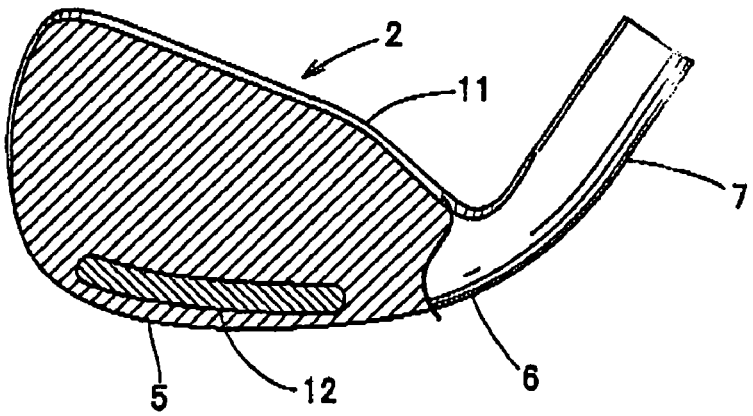
FIG. 27 is a schematic front view showing the golf club head according to the seventh embodiment.

As shown in FIGS. 26 and 27, the head 2 according to a seventh embodiment comprises the head body 11 made from a forgeable (malleable) metal with strength to withstand hits by a golf ball. The forgeable metal comprises, for example, copper (SUP-9). The face 4, sole 5 and hosel 7 are formed on the head body 11, while a concave portion 31 is formed on the rear of the head body 11 so that the head body 11 is to be cavity type. The disparate metallic member 12 made from one kind of metals different from that of the head body 11 is provided on the inside of the head body 11 corresponding to the sole 5. The disparate metallic member 12 is made from, for example, copper or copper alloy. The disparate metallic member 12 made from copper or copper alloy has large specific gravity compared to that of the head body 11 made from SUP-9, and low melting point compared to the forging temperature of the material of the head body 11. By employing the above-described structure, a feeling when hitting a golf ball can be improved and reflection coefficient thereof can also be improved.

Eighth Embodiment

Figure 28:
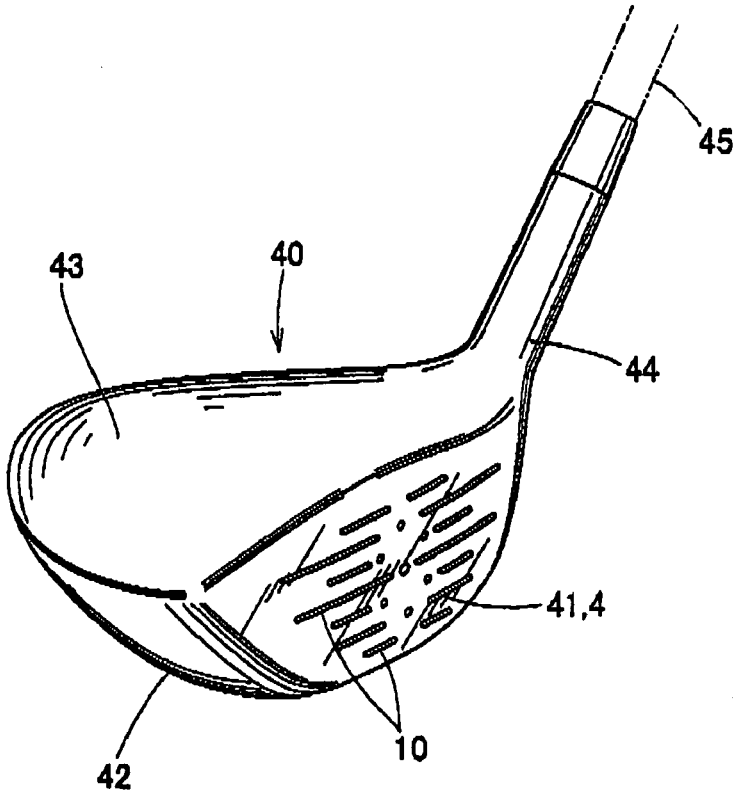
FIG. 28 is a perspective view showing a structure of a golf club head according to an eighth embodiment of the present invention.
Figure 29:
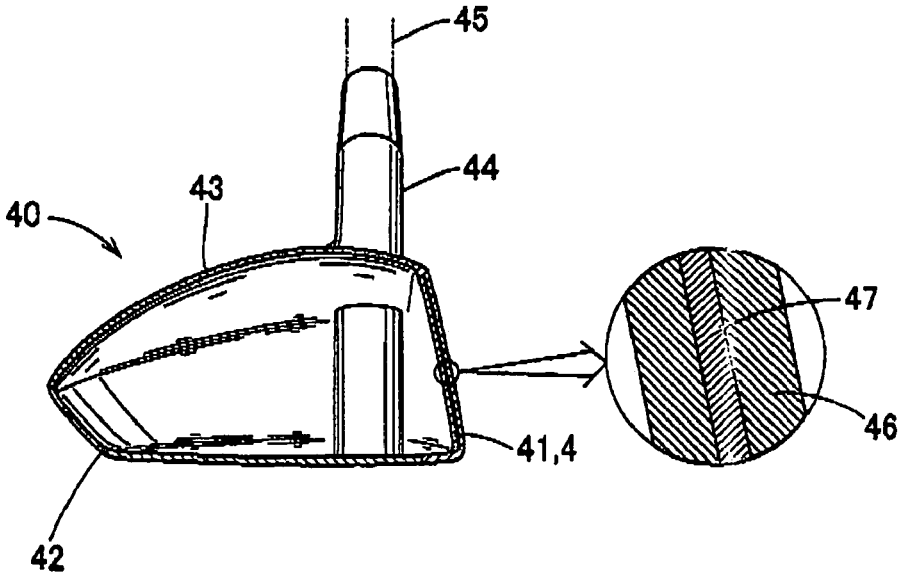
FIG. 29 is a cross sectional view showing the golf club head according to the eighth embodiment.

A golf club head according to an eighth embodiment of the present invention will now be described with reference to FIGS. 28 to 30. A hollow metal club head 40 which is so-called a "metal wood head" comprises a plurality of metallic shells. To be more precise, it comprises: a face shell 41 provided on the front side of the head 2; a sole and side shell 42 provided on the bottom and side of the head 40 as a body; and an upper shell 43 provided on the upper of the head 40 as the body, while those metallic shells are integrated one another by joining each edge thereof. Meanwhile, reference number 44 denotes a hosel provided on one side of the head 40 in a protruding condition with an angle, while a shaft 45 is joined thereto. The face shell 41 is as thin as about 3 mm thickness, and includes a disparate metallic member 47 in a material body 46. The material member 46 is made from, for example, titanium, while the disparate metallic member 47 confined in the material member 46 is made from, for example, titanium alloy. Accordingly, the material member 46 and the disparate metallic member 47 have the same main constituent and essentially have the same specific weight.

Figure 30:
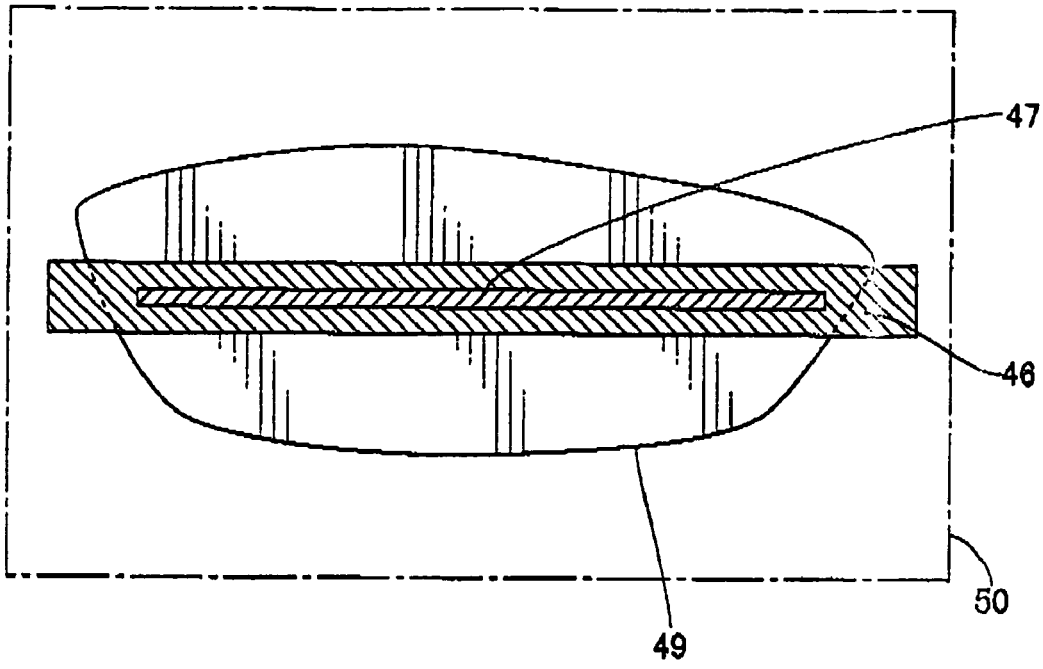
FIG. 30 is a transverse sectional view for explaining a method for manufacturing a golf club head according to the eighth embodiment.

As shown in FIG. 30, the material body 46 in which the disparate metallic member 47 is confined, is placed on a lower die 50 having a mold 49 for forming the material body 46 in a shape of the head 40. Meanwhile, the material body 46 is pre-heated at hot forging temperature by a furnace or the like. The disparate metallic member 47 is also pre-heated at the hot forging temperature. In a state where the material body 46 is pre-heated at the predetermined temperature and placed on the lower die 50, the face shell 41 is formed by forging for allowing an upper die (not shown) to press the material body 46. Further, the face shell 41, sole and side shell 42 and upper shell 43 shaped by the hot forging are integrated one another by joining each edge. Still further, finishing processes such as forming score lines (grooves 10) on the face 4, polishing the entire surface of the head 40 or the like are carried out. Meanwhile, the face shell 41 includes the disparate metallic member 47 according to this embodiment, but the sole and side shell 42, the upper shell 43 may also include the disparate metallic member (not shown) in the same manner.

By providing the disparate metallic member 47 inside the metal body 46 in the relatively thin face shell 41 of the hollow metal club head 40 with a relatively thin thickness, the weight balancing of the head 40 can be adjusted, the strength thereof can be improved, and the thickness thereof can be adjusted compared to a hollow metal head having a face shell made from one metallic member.

Ninth Embodiment

Figure 31:
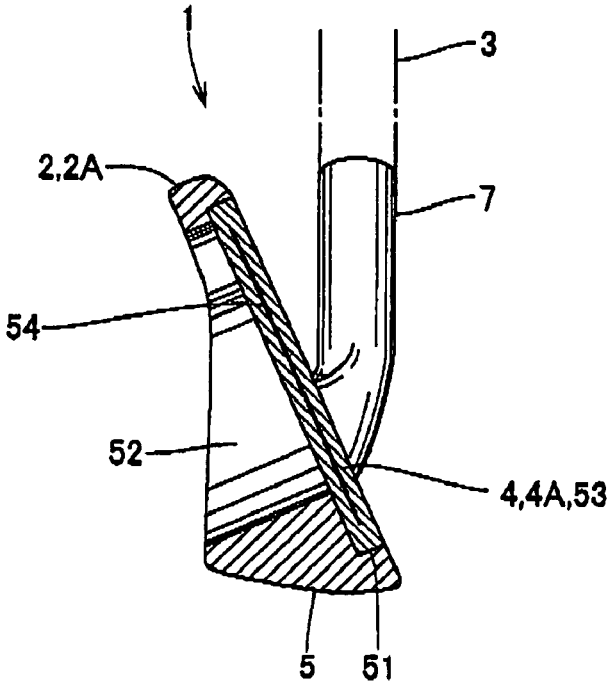
FIG. 31 is a cross sectional view showing a golf club head according to a ninth embodiment of the present invention.
Figure 32:
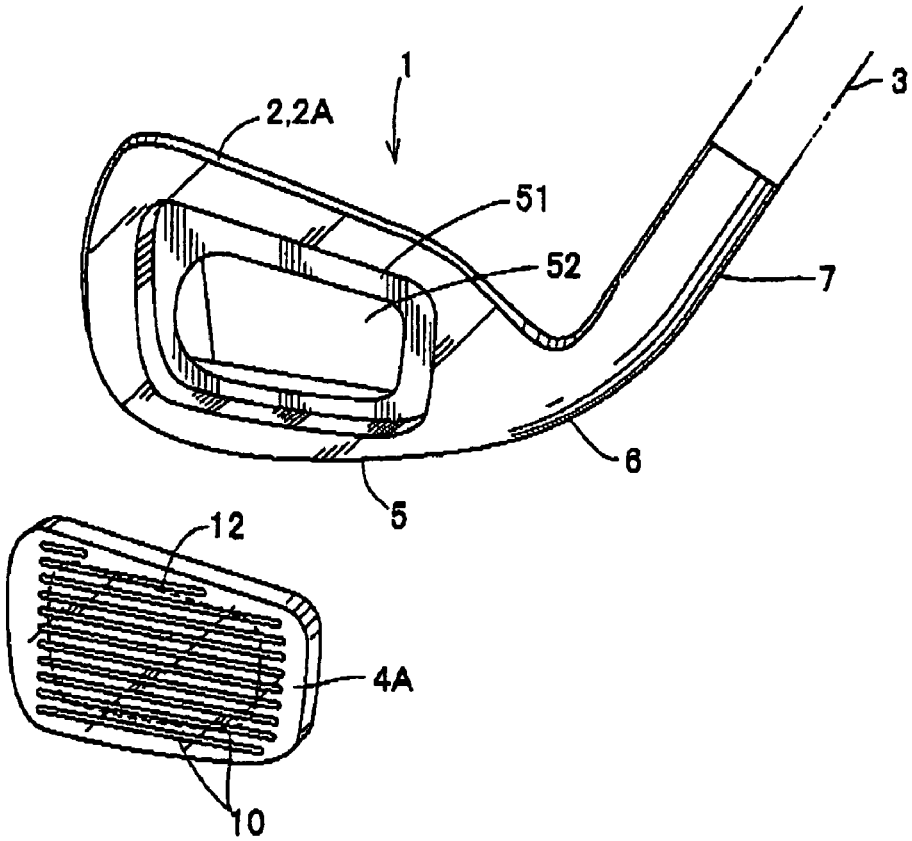
FIG. 32 is an exploded perspective view showing the golf club head according to the ninth embodiment.

As shown in FIGS. 31 and 32, in an iron type golf club head 2 according to a ninth embodiment, an opening 52 corresponding to the position of the face 4 is formed on a head body 2A via a concave portion 51. A face plate 4A is fixed on the concave portion 51. The face plate 4A is formed in the similar way as shown in FIG. 30. To be more precise, a material body (not shown) confining a disparate metallic member (not shown) is placed on a lower die (not shown) having a mold for forming the material body in a shape of the face plate 4A. Meanwhile, the material body and the disparate metallic member are pre-heated at the hot-forging temperature of the material body. In a state where the material body is placed on the lower die, the face plate 4A confining the disparate metallic member therein is formed by hot-forging for allowing an upper die (not shown) to press the material body.

Tenth Embodiment & Eleventh Embodiment

Figure 33:
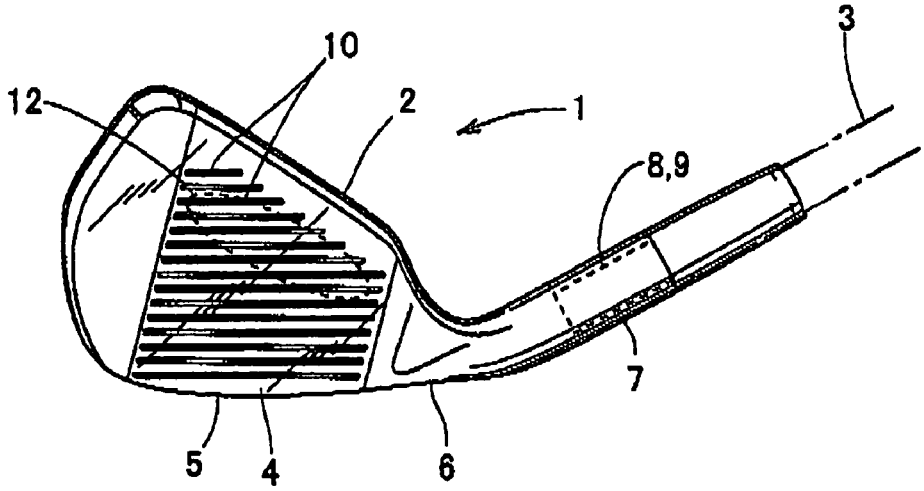
FIG. 33 is a perspective view showing a structure of a golf club head according to a tenth embodiment of the present invention.
Figure 34:
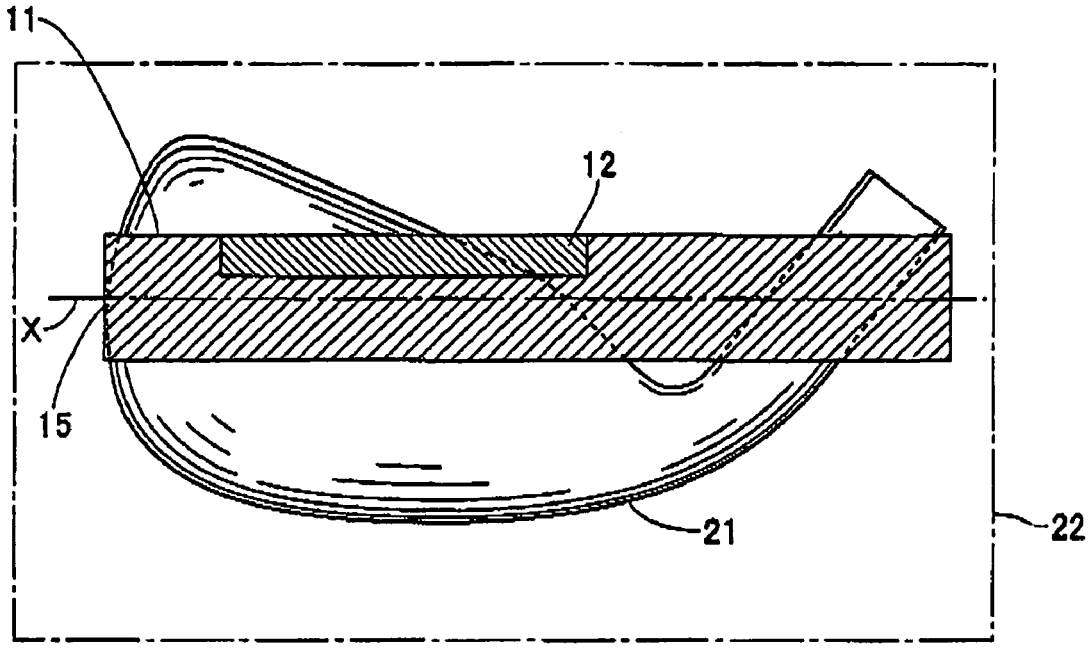
FIG. 34 is a transverse sectional view for explaining a method for manufacturing the golf club head according to the tenth embodiment.
Figure 35:
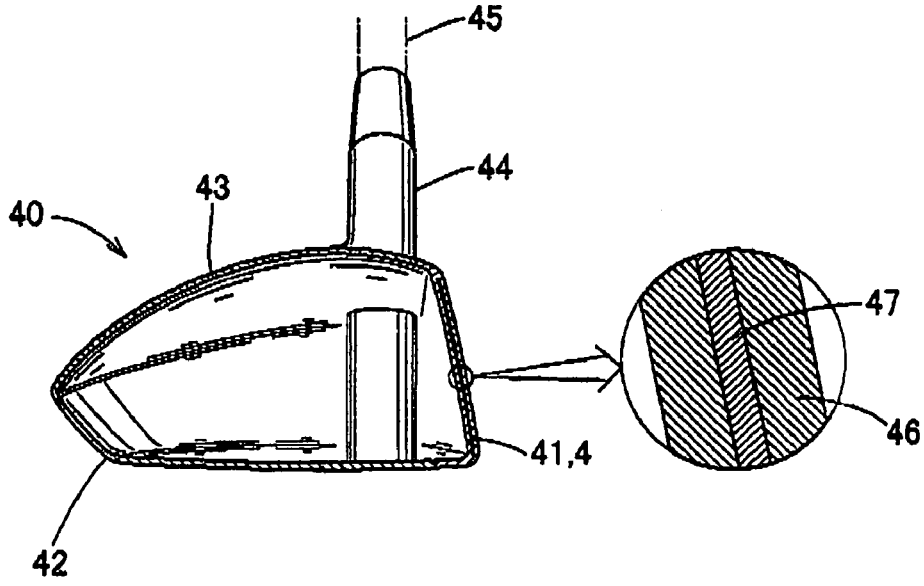
FIG. 35 is a cross sectional view showing a golf club head according to an eleventh embodiment of the present invention.
Figure 36:
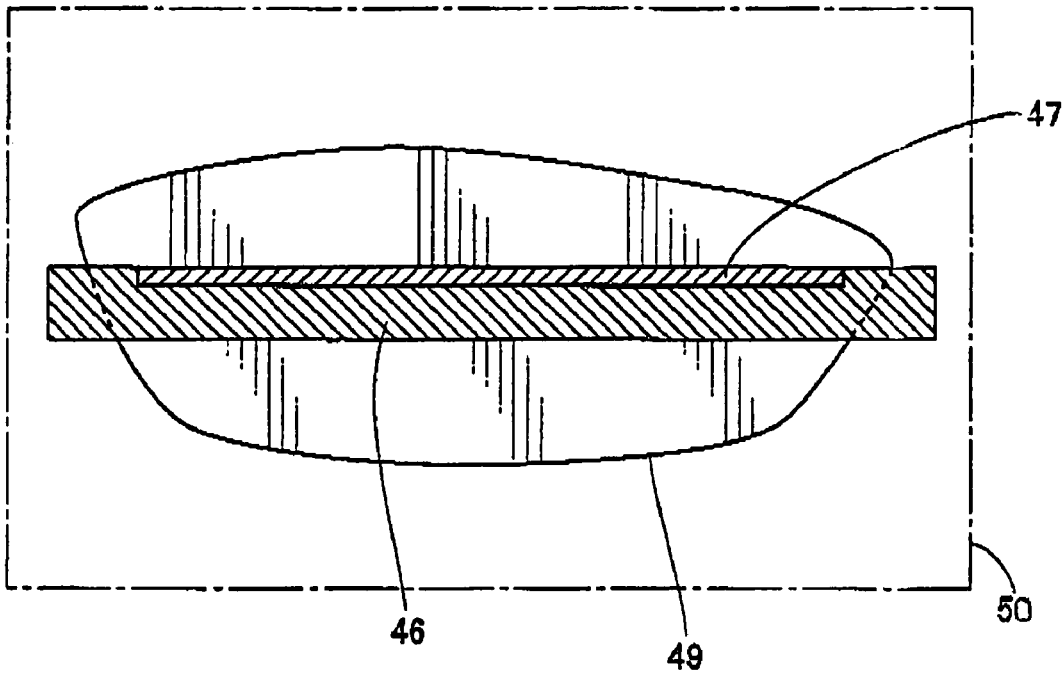
FIG. 36 is a transverse sectional view for explaining a method for manufacturing the golf club head according to the eleventh embodiment.

As shown in FIGS. 33 and 34, according to a tenth embodiment, the iron type head 2 is formed by: pre-heating the material body 13 at the forging temperature of the material body 13 in which the disparate metallic member 12 is attached onto the surface thereof, placing the material body 13 on the lower die 22; and hot-forging the material body 13. Moreover, as shown in FIGS. 35 and 36, according to an eleventh embodiment, the face shell 41 of the head 40 is formed by: pre-heating the material body 46 at the forging temperature of the material body 13 in which the disparate metallic member 47 is attached on the surface region thereof, placing the material body 46 on the lower die 50; and hot-forging the material body 46. The degree of freedom for designing the head can be improved according to those tenth and eleventh embodiments. Meanwhile, in the tenth and eleventh embodiments, the disparate metallic member 12, 47 may be plural and the plural disparate metallic members may be made from plural kinds of metal. Those plural disparate metallic members may be stacked as described in the third embodiment. Further, the disparate metallic member 12, 47 may have the same main constituent as the material body 13, 46.

Various embodiments and changes may be made thereonto without departing from the broad spirit and scope of the invention. The above-described embodiments are intended to illustrate the present invention, not to limit the scope of the present invention. The scope of the present invention is shown by the attached claims rather than the embodiments. Various modifications made within the meaning of an equivalent of the claims of the invention within the claims are to be regarded to be in the scope of the present invention.

What is claimed is:

1. A method for manufacturing a golf club head comprising: allowing a metallic material to contain n number of metallic members, said metallic material being for forming a golf club head having a face and a sole, and formed in columnar shape, while n number of said metallic members have a low melting point compared to a forging temperature of said metallic material respectively;

shaping said golf club head by forging said metallic material and n number of said metallic members while heating said metallic material and n number of said metallic members at the forging temperature of said metallic material; and applying finishing processes to said shaped golf club head, wherein:

n is a natural number and;

said golf club head is shaped by forging said metallic material and n number of said metallic members so that n number of said metallic members are confined inside said golf club, corresponding to either the face or the sole of said golf club head, wherein said metallic material is allowed to contain n number of said metallic members by: equiaxialiy forming said metallic material with a bore; inserting n number of said metallic members into said bore; and plugging said bore while using a plug made from metal having a same major constituent as said metallic material.

2. The method for manufacturing a golf club head according to claim 1, wherein:

n is 1; and said golf club head is shaped by: inserting said one metallic member into said bore and plugging said bore; and forging said metallic material and said one metallic member so that said one metallic member is confined inside said golf club head, corresponding to the sole o said golf club head.

3. A method for manufacturing a golf club head comprising:

allowing a metallic material to contain n number of metallic members, said metallic material being for forming a golf club head having a face and a sole, and formed in a columnar shape;

shaping said golf club head by forging said metallic material and n number of said metallic members while heating said metallic material and n number of said metallic members at he forging temperature of said metallic material; and applying finishing processes to said shaped golf club, head, wherein:

n is a natural number; and said golf club head is shaped by forging said metallic material and n number of said metallic members so that n number of said metallic members are confined inside said golf club, corresponding to either the face or the sole of said golf club head, wherein said metallic material is allowed to contain n number of said metallic members by: equiaxially forming said metallic material with a bore; inserting n number of said metallic members into said bore; and plugging said bore while using a plug made from a metal having a same major constituent as said metallic material.

4. The method for manufacturing a golf club head according to claim 3, wherein:

n is 1; and said golf club head is shaped by: inserting said one metallic member into said bore and plugging said bore; and forging said metallic material and said one metallic member so that said one metallic member is confined inside said golf club head, corresponding to the sole of said golf club head.

* * * * *